United States Patent [19]

Almér et al.

[11] 4,089,615

[45] May 16, 1978

[54] CONCRETE BLOCK, PRIMARILY INTENDED FOR USE AS A ROAD BARRIER

[76] Inventors: Bengt Önnert Almér, Saltholmsgatan 55, Vastra Frolunda, Sweden, 421 76; Karl Gunnar Gidlöf, Sjogangen 28, Vastra Frolunda, Sweden, 421 71

[21] Appl. No.: 793,615

[22] Filed: May 4, 1977

[30] Foreign Application Priority Data

May 11, 1976 Sweden ..... 7605335

[51] Int. Cl.[2] ..... E01F 13/00

[52] U.S. Cl. ..... 404/6

[58] Field of Search ..... 404/7, 6, 9; 256/13.1

[56] References Cited

U.S. PATENT DOCUMENTS

| | | | |
|---|---|---|---|
| 919,788 | 4/1909 | Smith | 404/7 X |
| 1,175,962 | 3/1916 | Latham | 404/6 X |
| 2,725,958 | 12/1955 | Porter | 404/6 X |
| 3,209,662 | 10/1965 | Morton | 404/6 |
| 3,308,724 | 3/1967 | Smith | 404/7 |
| 3,448,963 | 6/1969 | Gravisse | 404/6 X |
| 3,636,829 | 1/1972 | Palmer | 404/7 |
| 3,678,815 | 7/1972 | Yonker | 404/6 |

*Primary Examiner*—Nile C. Byers

*Attorney, Agent, or Firm*—Newton, Hopkins & Ormsby

[57] ABSTRACT

A concrete block having an essentially triangular cross-sectional configuration and an elongate shape and intended to be used to temporarily or permanently delimit roadways, parking lots and the like. The block side faces have a concavely rounded configuration matching that of a vehicle wheel, and the block base comprises bevelled edge faces allowing the block to be tilted at a limited angle upon impact from e.g. a vehicle. An anchoring means of an essentially crank-like shape may be provided to improve the stability of the block, one leg of said crank extending vertically into the foundation whereas the other one projects vertically into a recess formed in the block, said recess having a conical shape to allow tilting of the block upon impact.

7 Claims, 5 Drawing Figures

Fig.3
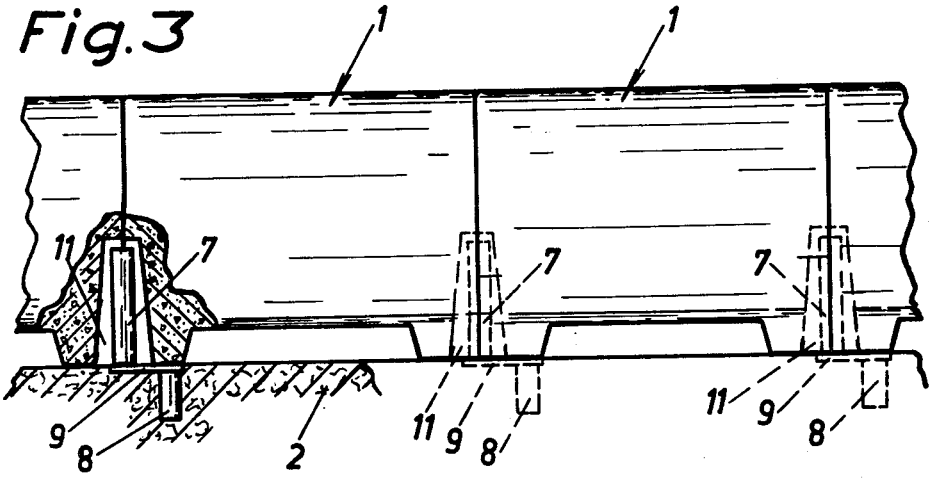
Fig.4
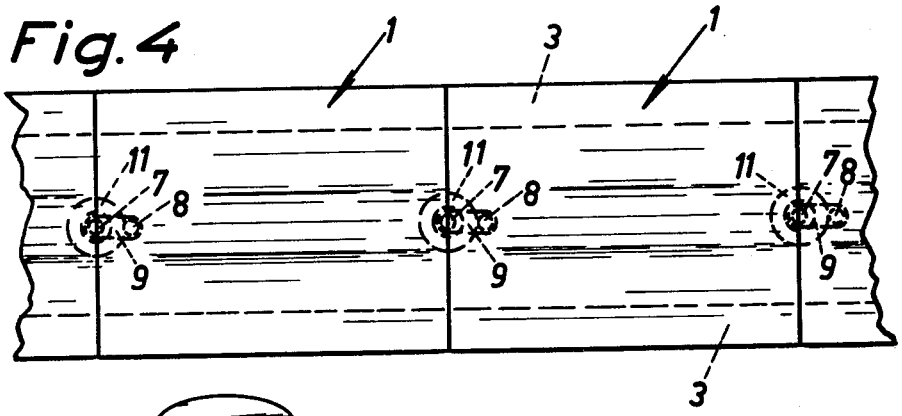
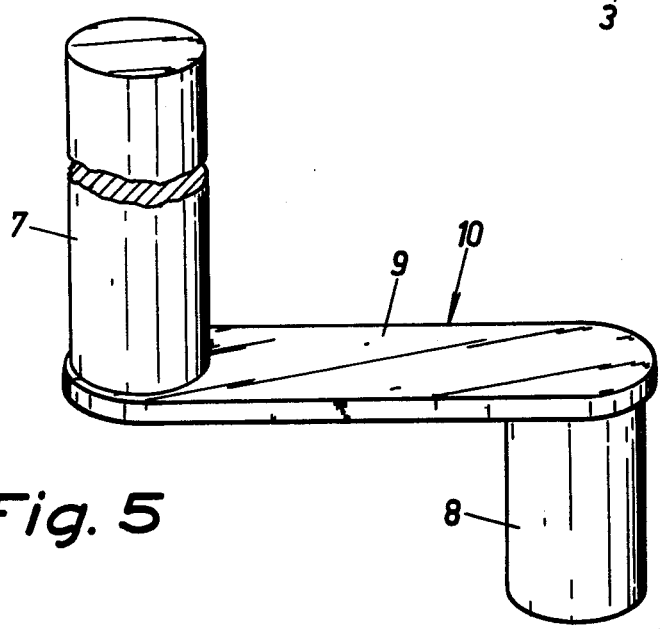
Fig. 5

CONCRETE BLOCK, PRIMARILY INTENDED FOR USE AS A ROAD BARRIER

BACKGROUND OF THE INVENTION

The subject invention concerns a concrete block which has an essentially triangular cross-sectional configuration and an elongate shape and which is intended to be used to delimit roadways, traffic lanes, parking lots and the like.

Concrete blocks of this kind have proved very useful to delimit roadways, parking lots and the like, temporarily as well as permanently. In order to function in a satisfactory manner, these blocks, when run into by a motor vehicle, must be able to yield in such a manner as not to damage the vehicle while at the same time is should be possible to restore them easily to their initial positions. Prior-art concrete blocks of this kind do not always function satisfactorily in this respect, as they cause damage to the vehicle and in addition are difficult to restore to their initial positions.

SUMMARY OF THE INVENTION

The disadvantages outlined above are completely eliminated by the present invention which for the purpose indicated is characterised in that the side faces of the block have a concave, rounded configuration and in that the base face is bevelled at its edges, whereby the block becomes tiltable at a limited angle.

According to a further aspect of the invention, the block is anchored to the foundation by means of a crank-like stay, one leg of which extends downwards into the foundation whereas the opposite leg projects into a conical recess formed in the block.

According to a still further aspect of the invention, the vertical legs of the stay are cylindrical and interconnected by means of an intermediate section in the form of a flat iron bar.

BRIEF DESCRIPTION OF THE DRAWINGS

The invention will be described in more detail in the following with reference to the accompanying drawings, wherein FIG. 3 is a lateral view of a barrier formed by the blocks in accordance with the invention, FIG. 4 is a plan view of the barrier of FIG. 3, and FIG. 5 illustrates a stay by means of which the concrete blocks in accordance with the invention are assembled.

DETAILED DESCRIPTION OF A PREFERRED EMBODIMENT

Figure 1:
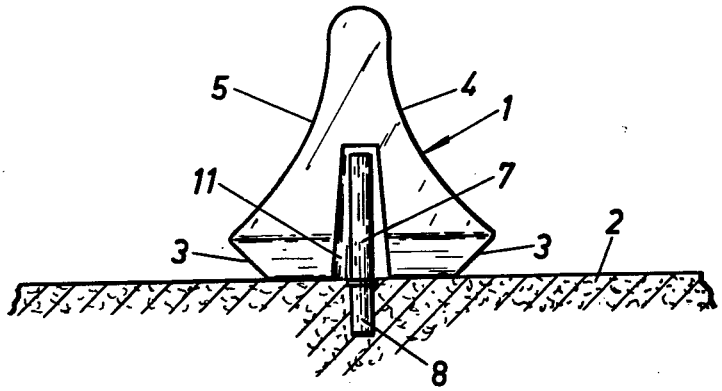
FIG. 1 is a lateral view of a block in its normal position.

As illustrated in FIG. 1, the concrete block in accordance with the invention is intended to be placed on a foundation 2, and to form a barrier of the desired length, several blocks are positioned end-to-end as illustrated in FIGS. 3 and 4.

The surface on which the block 1 rests on the foundation 2 is reduced by bevelled sections 3 and the side faces 4 and 5 of the block have a rounded, concave configuration.

Figure 2:
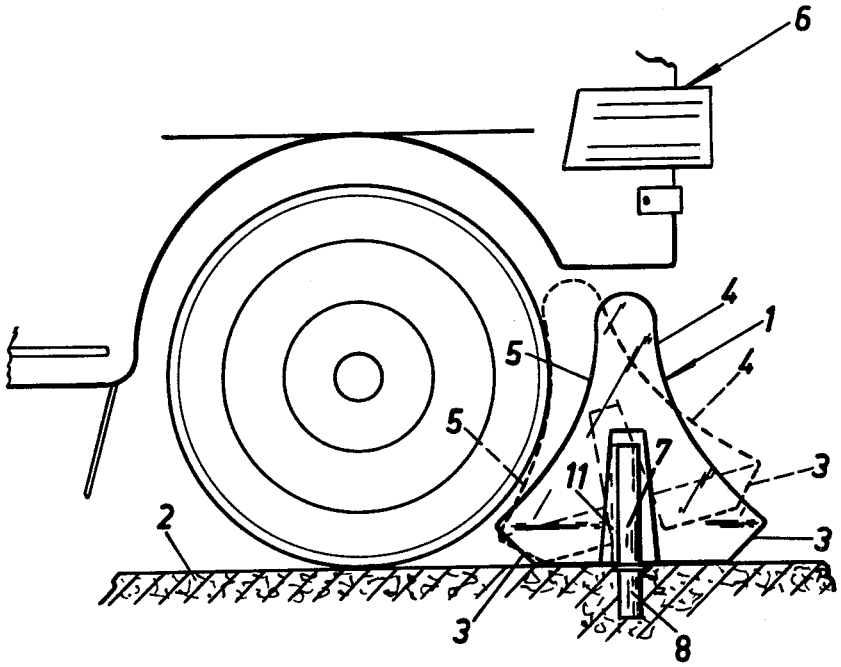
FIG. 2 illustrates the course of events when a vehicle drives into a block in accordance with the invention.

In case a vehicle 6 drives into the block in accordance with the invention, the block will tip over slightly as illustrated in FIG. 2, whereby the position of the rounded face 5 to some extent will adjust to the configuration of the wheel. In addition owing to the bevelled section 3, the block 1 will tilt somewhat, whereby its area of contact with the foundation 2 is considerably reduced, resulting in a corresponding reduction of the friction between the block and the foundation. Consequently, the block may slide more easily, which in turn means less risk of damage to the vehicle. Furthermore, the rounded block faces form a path guiding the vehicle back onto the road way.

However, should the blocks 1 slide too easily, they might not be sufficiently efficient as a barrier, and in accordance with a further characteristic of the invention it is advantageous to anchor them in a particular manner to the foundation. For this purpose it is preferred to use the stay shown in FIG. 5. comprising two tubular legs 7 and 8 which are interconnected by an intermediate section 9, preferably in the form of a flat iron bar in such a manner that an essentially crank-like element 10 is obtained. As illustrated in FIGS. 3 and 4, one leg 8 of the crank-like anchoring element 10 is to be inserted into the ground whereas the other leg 7 is intended to project into a conical recess 11 formed in the bottom face of the block, approximately up to half the height of the block. The conical configuration of the recess 11 allows the block 1 to tilt without difficulty in the manner indicated in FIG. 2 when driven into. In the embodiment illustrated, the conical recess 11 is formed adjacent to the joints between two blocks, but this is an exemplified embodiment only, as the recess 11 naturally may be arranged in a different manner. In case of a collision between the block 1 and a vehicle, the former thus will be displaced only as far as is allowed by the crank-like element 10, which should be sufficient to make the driver of the vehicle 6 aware of what is happening, and at the same time the blocks 1 remain in a position from which they may easily be restored to their correct position.

The invention thus provides a concrete block which is intended for use as a road barrier and likewise is well suited to delimit roads, parking lots and the like without constituting any risk or hazard to the vehicle and in addition the blocks may be easily restored to their correct positions when they have been displaced by a vehicle or otherwise. Naturally, many modifications are possible whithin the scope of the appended claims, among them the arrangement of the conical recesses 11 housing the anchoring elements 10 as indicated above. The angle of the bevelled areas 3 naturally may be varied according to the desired tilting angle of the block and also the curvature radious of faces 4 and 5 is variable to match various possible objects. As appears from FIG. 3, the blocks may rest on feet, whereby lifting of the blocks is facilitated, but this embodiment does not fall within the scope of the invention. A suitable height of the block would be approximately 90 centimeters, but this measure should by no means be interpreted as a limitation of the invention.

What we claim is:

1. A traffic barrier for roadways comprising multiple modules arranged in end-to-end relationship along a roadway to form a substantially continuous barrier, each module of the barrier having a comparatively wide flat base and beveled shoulders rising from opposite sides of said base in diverging angular relationship, each module having above said beveled shoulders and on opposite sides of the module concave longitudinally extending faces whose heights above the beveled shoulders define the major portion of the height of each module and the height of said barrier, and each module having at least one anchoring recess in its bottom to receive loosely an upstanding roadway anchor element with enough clearance to allow substantial lateral tilting of each module on its beveled shoulders and some sliding on said flat base when either concave face of the module is engaged by the wheel of a vehicle moving along the roadway, each module being substantially self-righting by gravity after tilting.

2. A traffic barrier for roadways as defined in claim 1, and said opposite side concave faces of each module being symmetrically disposed with relation to said wide flat base and said beveled shoulders laterally of the module.

3. A traffic barrier for roadways as defined in claim 2, and the top of each module being transversely rounded between said concave faces to form a substantially continuous rounded longitudinal crown on the barrier comprised of a multiplicity of said modules.

4. A traffic barrier for roadways as defined in claim 1 and each module having an anchoring recess in each end face thereof substantially at the lateral center of the module adapted to register with a complementary recess in the end face of the next adjacent module in said traffic barrier, each registering pair of said recesses loosely receiving an upstanding roadway anchor element.

5. A traffic barrier for roadways as defined in claim 4 and a multiplicity of roadway anchor elements corresponding in number to said registering pairs of complementary recesses, and each anchor element being crank-like and having a lower crank leg anchored in the roadway and an upper crank leg offset from the lower leg and projecting upwardly and loosely into the space formed by each registering pair of said recesses.

6. A traffic barrier for roadways as defined in claim 5, and each module having short roadway engaging feet depending therefrom at its opposite ends and elevating the body portion of each module a predetermined small distance above the surface of the roadway.

7. A traffic barrier for roadways as defined in claim 1, and each module in said traffic barrier having a total height of roughly ninety centimeters above the roadway.

* * * * *